United States Patent [19]

Hoskinson et al.

[11] 4,205,575

[45] Jun. 3, 1980

[54] BINARY INTERPOLATOR FOR ELECTRONIC MUSICAL INSTRUMENT

[75] Inventors: William R. Hoskinson, Geneva, Ill.; Peter E. Solender, Williamsville, N.Y.

[73] Assignee: The Wurlitzer Company, DeKalb, Ill.

[21] Appl. No.: 907,719

[22] Filed: May 19, 1978

[51] Int. Cl.[2] ..... G10H 1/02

[52] U.S. Cl. ..... 84/1.01; 84/1.26; 84/1.27; 364/719; 364/723

[58] Field of Search ..... 84/1.01, 1.03, 1.24, 84/1.26, 1.27, DIG. 7; 364/718, 719, 723

[56] References Cited

U.S. PATENT DOCUMENTS 4,154,133 5/1929 Kitawaga ..... 84/1.27

*Primary Examiner*—J. V. Truhe
*Assistant Examiner*—William L. Feeney
*Attorney, Agent, or Firm*—Trexler, Wolters, Bushnell & Fosse, Ltd.

[57] ABSTRACT

A binary interpolator circuit is embodied in an electronic musical instrument for producing a relatively smooth, inaudible transition between steps of different amplitude in a stepwise advancing or decreasing waveform, such as an envelope signal for a note from a percussive type instrument or voice such as a piano. The binary interpolator circuit includes a counter circuit for producing a sequence of stepwise changing binary coded signals and a combining circuit for combining the interpolating signals, in the sequence produced, with a binary coded scaling signal corresponding to the amplitude difference between the two points in the stepwise changing waveform between which interpolation is desired. A comparator circuit compares the interpolating signals, in the sequence produced, with the scaling signal and produces an output control signal for indicating whether the binary coded numbers corresponding to the respective interpolating and scaling signal are equal. A control circuit is responsive to this control output signal for respectively allowing or inhibiting the production of the interpolating signals. In a preferred embodiment, multiplexing and demultiplexing circuits are provided for serially multiplexing a plurality of waveforms to be interpolated and simultaneously serially multiplexing a plurality of interpolating signals for combining at the combining circuit. Demultiplexing circuits are provided for serially outputting both the control signals and the waveforms thus interpolated.

15 Claims, 10 Drawing Figures

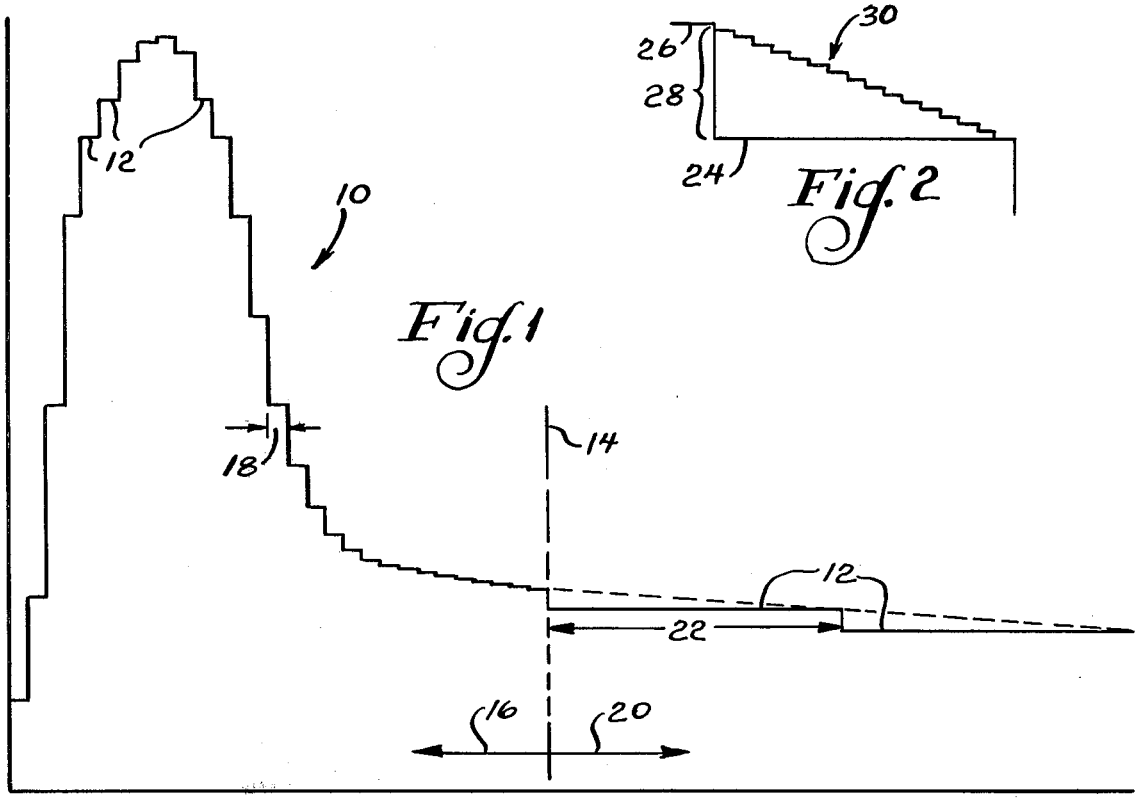
Fig. 1
Fig. 2
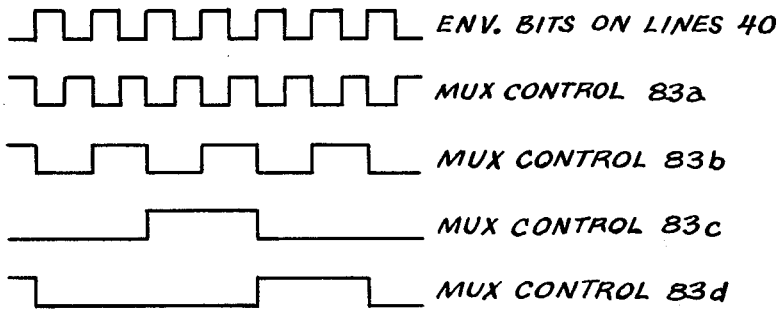
Fig. 6
Fig. 4
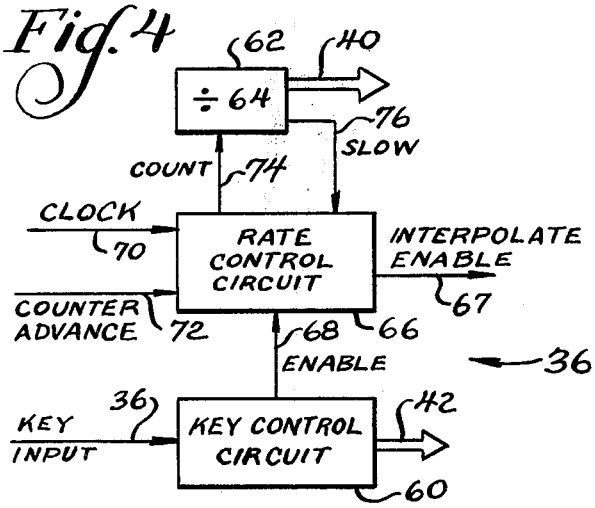

BINARY INTERPOLATOR FOR ELECTRONIC MUSICAL INSTRUMENT

BACKGROUND OF THE INVENTION

This invention relates generally to digital waveforming and wave shaping techniques as applied to electronic musical instruments, and more specifically to a binary interpolator circuit for digitally reducing abrupt changes in a slow varying portion of a waveform.

While the present invention may find use in a variety of applications, the description is facilitated by addressing the specific problem of binary interpolation of the decay portion of an envelope waveform of a note produced by an electronic musical instrument, and more specifically to an envelope waveform of a percussion voice, such as piano, of such an instrument. The invention is equally applicable to any data processing system where it is desired to reduce data transitional step sizes.

Many digital electronic processing techniques are currently being used in electronic musical instruments. Such digital techniques have proven useful in performing numerous relatively complex functions in the generation of electronic musical effects approximating very closely the characteristic sounds of a number of acoustic instruments, as for example a piano. Moreover, as digital electronic components become increasingly available both in conveniently small package sizes and at relatively low cost, the utilization of such components has also led to increased savings in both cost and size of the finished products. In electronic musical instruments, such components perform relatively complex functions to more accurately simulate sounds of acoustic musical instruments.

One such electronic tone generating system is described, for example in U.S. Pat. No. 4,067,253. In this patent, a specific system is described for simulating the sound of a piano, in accordance with the relative force with which the keys of the instrument are struck. Broadly speaking, a digital or stepwise changing waveform is produced simulating the characteristic envelope curve of a percussive type note as is played by a conventional piano. When this stepwise changing digital waveform is fed to audio output circuits, it may be directly converted to analog form by an integrator or smoothing circuit which generally "smooths" the transitions between adjacent steps of the digital waveform. It wil be noted that in a stepwise changing digital waveform wherein the steps are of a relatively short time duration, ie. in the range of 30 to 40 milliseconds apart, that changes in amplitude between adjacent steps are generally not audibly noticeable. This is in part owing to the natural tendency of conventional amplifier circuits and speakers to respond somewhat more slowly than the abrupt changes of the digital waveform fed to their inputs. Another contributing "smoothing factor" is the tendency of the human ear to integrate or smooth rapid amplitude transitions somewhat. However, in a percussion voice envelope, such as a piano, there is a relatively long decay portion, wherein the digital steps or changes in amplitude may be spaced in time on the order of 300 to 400 milliseconds. During this portion of the waveform, primarily due to the longer spacing in time between amplitude changes, all but very slight amplitude changes are generally audibly noticeable.

Accordingly, the binary interpolator circuit according to this invention is adapted to modify these relatively long steps, or widely spaced amplitude changes, so as to produce a plurality of smaller steps, both in time and in amplitude. The end result thus is the same amplitude variation, covered over the same period of time but, comprising smaller amplitude, more closely spaced steps, so as not to be audibly noticeable.

OBJECTS AND SUMMARY OF THE INVENTION

Accordingly, it is a general object of this invention to provide a binary interpolator circuit for digitally reducing amplitude changes in a digitally produced, stepwise changing waveform.

A more specific object is to provide a binary interpolator circuit of the type described adapted to act upon only such amplitude changes of a digital waveform which are spaced apart by greater than a predetermined time increment.

Another object is to provide a binary interpolator circuit of the type described which is adapted to so modify a plurality of digital waveforms comprising notes played on an electronic musical instrument, to produce amplitude transitions which are not audibly noticeable, and to return the modified waveforms to audio reproduction portions of an associated instrument to be separately audibly reproduced in the order played.

Yet another object of this invention is to provide a binary interpolator circuit of the type described which is capable of performing the interpolating function for the notes of an electronic musical instrument, such as an electronic piano, having several octaves of notes selectively actuatable from a keyboard, while utilizing a minimum of electronic components, so as to minimize space requirements and costs thereof.

Briefly, and in accordance with the foregoing objects, a binary interpolator circuit according to this invention includes counter circuit means for producing a sequential binary coded interpolating signals at a predetermined rate, said interpolating signals comprising integrally sequentially advancing binary numbers. Combining circuit means combine each of the interpolating signals, in the sequence produced, with a binary coded scaling signal comprising the amplitude difference between two points of a waveform between which interpolation is desired, and also corresponding to a binary number. A comparator circuit compares the interpolating signals, in the sequence produced, with the scaling signal and produces a control output signal having a first value normally and changing to a second value when the advancing interpolating signals reach the same binary number as the binary scaling signal. A control circuit means is responsive to the control output signal for allowing or inhibiting the operation of the interpolator circuit, as required for completing the interpolation of the particular waveform portion whose binary coded scaling signal is being compared.

Other objects, features and advantages of this invention will become more readily apparent upon consideration of the following detailed description together with the accompanying drawings, wherein an exemplary embodiment is illustrated and described.

BRIEF DESCRIPTION OF THE DRAWINGS

In the Drawings:

FIG. 1 illustrates a digital waveform characteristic of an envelope of a percussion instrument;

FIG. 2 is an enlarged view of a portion of the waveform of FIG. 1, illustrating digital reduction thereof in accordance with this invention;

FIG. 4 is a block diagram of a portion of the exemplary instrument of FIG. 3;

FIG. 6 is a waveform diagram illustrating a form of multiplexer control signals for the circuit of FIG. 4.

DETAILED DESCRIPTION OF THE ILLUSTRATED EMBODIMENT

Figure 3:
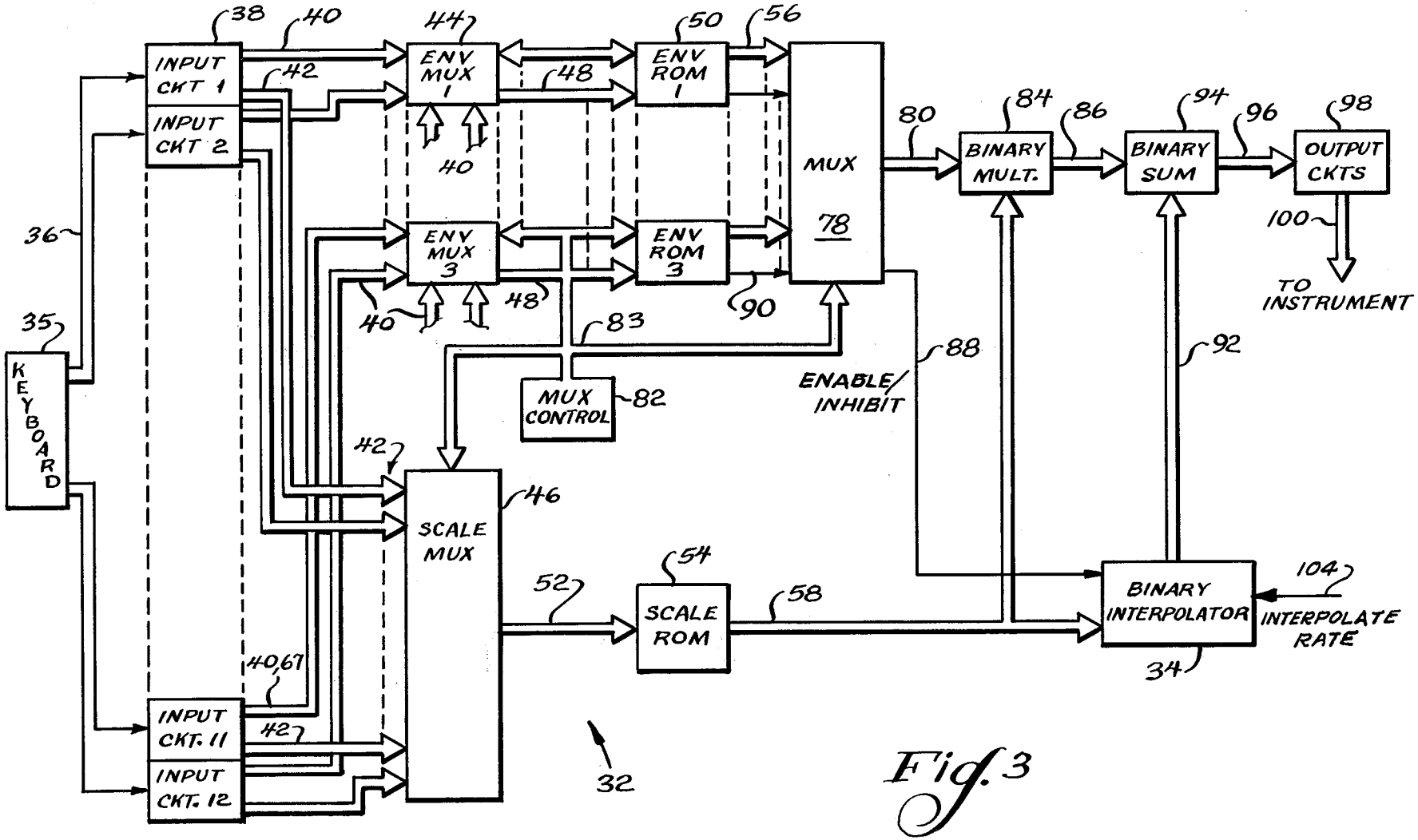
FIG. 3 is a block diagram of an exemplary musical instrument wherein the binary interpolator of this invention is embodied.

Referring now to the drawings, and initially to FIG. 1, a waveform designated generally 10 approximates an envelope waveform characteristic of a percussion voice of an electronic musical instrument, such as a piano voice. The waveform 10 is in digital form, and broadly speaking, comprises a series of digital electronic pulses 12 arranged in sequence to form a stepwise changing waveform. The waveform 10 consists generally of two parts, in the illustrated embodiment, as indicated by the dashed line 14. The portion to the left of the line 14, indicated by the arrow 16, corresponds generally to an attack portion and an initial part of a decay portion of a typical percussion voice envelope. It will be noted that in this portion 16 the pulses or steps 12 are characterized by a relatively short time duration or width, as indicated generally by a double arrow 18. In the illustrated embodiment, the width or time interval 18 of each of the pulses or steps 12 is on the order of 30 to 40 milliseconds. It will be appreciated, that due to the characteristics of audio reproduction equipment such as amplifiers and speakers, as well as to the tendency of the human ear to integrate or smooth such amplitude changes, that even relatively large changes in amplitude occuring at closely spaced time intervals such as the interval 18, are not audibly noticeable as such.

The second portion of the waveform 10, as indicated generally by the arrow 20, is characterized by greater pulse width or time interval of the pulses or steps 12, as indicated generally by the double arrows 22. This corresponds generally to a latter part of the decay envelope of a percussion instrument voice, such as a piano voice. In the illustrated embodiment, the pulse widths or time intervals 22 are on the order of 300 to 400 milliseconds. Accordingly, it will be appreciated that all but very small changes in amplitude between adjacent pulses or steps 12 are audibly noticeable at this relatively large time interval. Accordingly, it is an important object of this invention to provide means for digitally interpolating or reducing these relatively widely spaced steps 12 in the waveform portion 20, as illustrated in FIG. 2.

Accordingly, the binary interpolator of this invention functions generally as indicated in FIG. 2 for digitally reducing a relatively wide step or pulse 24. This pulse 24 differs in amplitude from a last preceeding pulse 26 by an amount indicated by the reference numeral 28. The interpolator acts to convert this amplitude step into a plurality of smaller steps designated generally 30. It will be seen that the pulses or steps 30 are of substantially smaller width or time duration than the pulse 24, and define substantially smaller changes in amplitude therebetween than the amplitude change 28 between the steps 24 and 26. Accordingly, the step or pulse 24 is digitally reduced or interpolated to a plurality of small steps 30, the end result being the same, that is the same amplitude variation 28 is covered over the same time period or pulse width 24.

Referring now to FIG. 3, a block diagram illustrates an exemplary envelope generating circuit designated generally 32, suitable for producing the envelope waveform 10 of FIG. 1. A binary interpolator circuit 34, in accordance with this invention, cooperates with the circuit 32 to digitally reduce portions of the waveform 10, in the manner illustrated by FIG. 2. The envelope generating circuit 32 is suitable for use in an electronic musical instrument and is generally similar to that described in U.S. Pat. No. 4,067,253 assigned to the assignee of the present application. As illustrated in FIG. 3, the circuit 32 receives input signals from a keyboard 35 over lines 36, each of the lines 36 generally corresponding to one note or key of the keyboard 35. These lines 36 are fed to a plurality of input circuits 38. In the illustrated embodiment, the circuit 32 is arranged for cooperating with 12 notes or one octave of the keyboard 35, and hence 12 input circuits 38 are illustrated. It will be appreciated that a circuit such as the circuit 32 could be utilized in conjunction with each octave of a multiple octave keyboard 35.

To facilitate handling of a plurality of signals on the lines 36, corresponding to a plurality of notes being actuated on the keyboard 35 either simultaneously, or during a relatively short period of time, serial multiplexing is utilized. Specifically, it will be seen that each of the input circuits 38 includes two sets of outputs 40 and 42, the outputs 40 being fed to one of a plurality of envelope multiplexing circuits 44 and the output lines 42 being fed to a scale multiplexing circuit 46. In the illustrated embodiment, the envelope multiplexing circuits 44 are three in number, each being adapted to receive the sets of outputs 40 from four of the input circuits 38. The scale multiplexing circuit 46 receives the sets of inputs 42 from all of the twelve input circuts 38. Serially multiplexed output lines 48 of the envelope multiplexers 44 feed envelope matrix conversion circuits, comprising read only memories (ROM) 50. In the illustrated embodiment the ROMS 50 are three in number, one being associated with each of the multiplexers 44. Similarly, serially multiplexed outputs on lines 52 from the scale multiplexer 46 are fed to a matrix conversion circuit comprising a scale ROM 54.

In the illustrated embodiment, the envelope ROMS 50 produce a binary encoded signal on their output lines 56 comprising envelope shape data generally corresponding to the shape of the envelope waveform illustrated in FIG. 1. The scale ROM outputs binary encoded data on its output lines 58 generally corresponding to the scale or relative amplitude of the particular note actuated at the keyboard 35. In this regard, the input circuits 38 are adapted to be responsive to the relative velocity or force of actuation of individual keys of the keyboard 35 for causing the scale ROM 54 to produce output signals corresponding to the relative amplitude of the particular note actuated. This signal of course remains the same for the duration of the waveform or envelope of that particular note. Thus, the envelope signals for each note actuated on the keyboard 34 are output on the lines 56 and the scaling or relative amplitude signals therefore are output on the lines 58.

Referring to FIG. 4, a typical input circuit 38 is illustrated in additional detail, for further clarifying the generation of these envelope and scaling signals. Briefly, each input circuit 38 includes a key control circuit 60 which functions to convert the relative velocity or hardness of actuation of the associated key or note received as a signal on one of the input lines 36 to a binary coded output on the output lines 42 for addressing the ROM 50 in similar fashion to the above-referenced U.S. Patent. A divide-by-64 counter 62 produces a sequentially advancing count in binary form at its output lines 40 for addressing the ROM 50. These 64 counts correspond to the number of pulses or steps 12 forming the waveform 10 of FIG. 1. A rate control circuit 66 receives an enable input 68 from the key control circuit 60, in response to actuation of a key on the keyboard 34 (the signal received on the line 36). A clock input 70 to the rate control circuit 66 delivers a clock pulse at a "fast count" rate generally corresponding to the time intervals or pulse widths 18 of the waveform illustrated in FIG. 1. A counter advance input line 72 presents an enable signal to the rate control circuit for allowing advancement of the divide-by-64 counter 62, via a control or count line 74. A slow count line 76 feeds a control signal to the rate control circuit 66 at the 32nd count of the divide-by-64 counter 66. In the illustrated embodiment, this 32nd count occurs at the dividing line 14 of the waveform of FIG. 1. Accordingly, the two portions or halves 16 and 20 of the waveform 10 each comprise 32 of the pulses or steps 12. The slow count control line 76 causes the rate control circuit 66 to produce an interpolate enable signal on an output 67 and to reduce or slow the rate of counting of the divide-by-64 counter via the count line 74, to produce a "slow count". Hence, the pulses 12 of the portion 20 of the waveform 10 of FIG. 1, are characterized by the longer width or time interval 22. From the foregoing it will be seen that the envelope signals on the line 40 determine the general shape of the waveform 10 of FIG. 1, as well as the time intervals or pulse widths 18 and 22 thereof. The signals on the lines 42 determine the scale or amplitude of pulses forming the waveform 10, in accordance with the speed or hardness of actuation of the associated key on the keyboard 35. The envelope ROMS 50 and scale ROM 54 convert the signals into suitable binary coded signals on their respective output lines 56 and 58 which may be combined to form the waveform 10 of FIG. 1.

Referring again to FIG. 3, the envelope output signals on the lines 56 are fed to multiplexers 78, which serially multiplex the outputs 56 associated with individual ones of the twelve keys of the keyboard 35 handled by the circuit 32. The multiplexers 78 then present the selected signal to output lines 80. A multiplex control circuit (MUX CONTROL) 82 provides suitable signals over lines 83 to the multiplexers 44, 46 and 78 for simultaneously serially multiplexing their respective inputs, to assure that the signals on the output lines 56, 58 and 80 appear simultaneously for each key or note of the keyboard 35 which is actuated. The serially multiplexed scaling signals and envelope signals on the lines 58 and 80 are then combined in a binary multiplier circuit 84 whose output lines 86 carry binary signals corresponding to the steps or pulses 12 of the waveform 10 of FIG. 1.

The binary interpolator circuits 34 of this invention receives the scaling signal on the lines 58 and an enable/inhibit or control signal on a line 88, corresponding to a control signal multiplexed through by the multiplexers 78 from the input lines 90 from the ROMS 50. This control or enable/inhibit signal is generally output by the ROMS 50 in response to the divide-by-64 counter 66 reaching the 32nd count of the cycle. It is at this point, as mentioned above, that the pulses or steps 12 of the waveform 10 of FIG. 1 are characterized by the longer time interval or pulse widths 22. In the illustrated embodiment, it is these pulses of longer pulse width or time interval, which are to be interpolated or reduced, as illustrated in FIG. 2. Hence, the interpolator circuit 34 is enabled for acting only on these pulses, and inhibited from acting upon the pulses of shorter pulse width or time interval 18 of the portion 16 of the waveform 10 of FIG. 1. The binary interpolator 34 produces interpolating signals in binary form on output lines 92 in response to the enable signal on line 88 and to an externally supplied interpolate rate signal on a line 104, as hereinafter described. These output lines 92 are fed into a binary summation circuit 94 which also receives the signal lines 86. Thus, the interpolating signals on the lines 92 are combined with the envelope pulse signals on the lines 86, to accomplish interpolation or digital reduction in the manner illustrated in FIG. 2, to produce signals similar to the steps 30, in binary form on output lines 96. These signals are then fed to output circuits 98 where they are converted to suitable form to be fed to the electronic musical instrument audio reproduction circuits to comprise envelope waveforms for the notes to be audibly reproduced.

Figure 5:
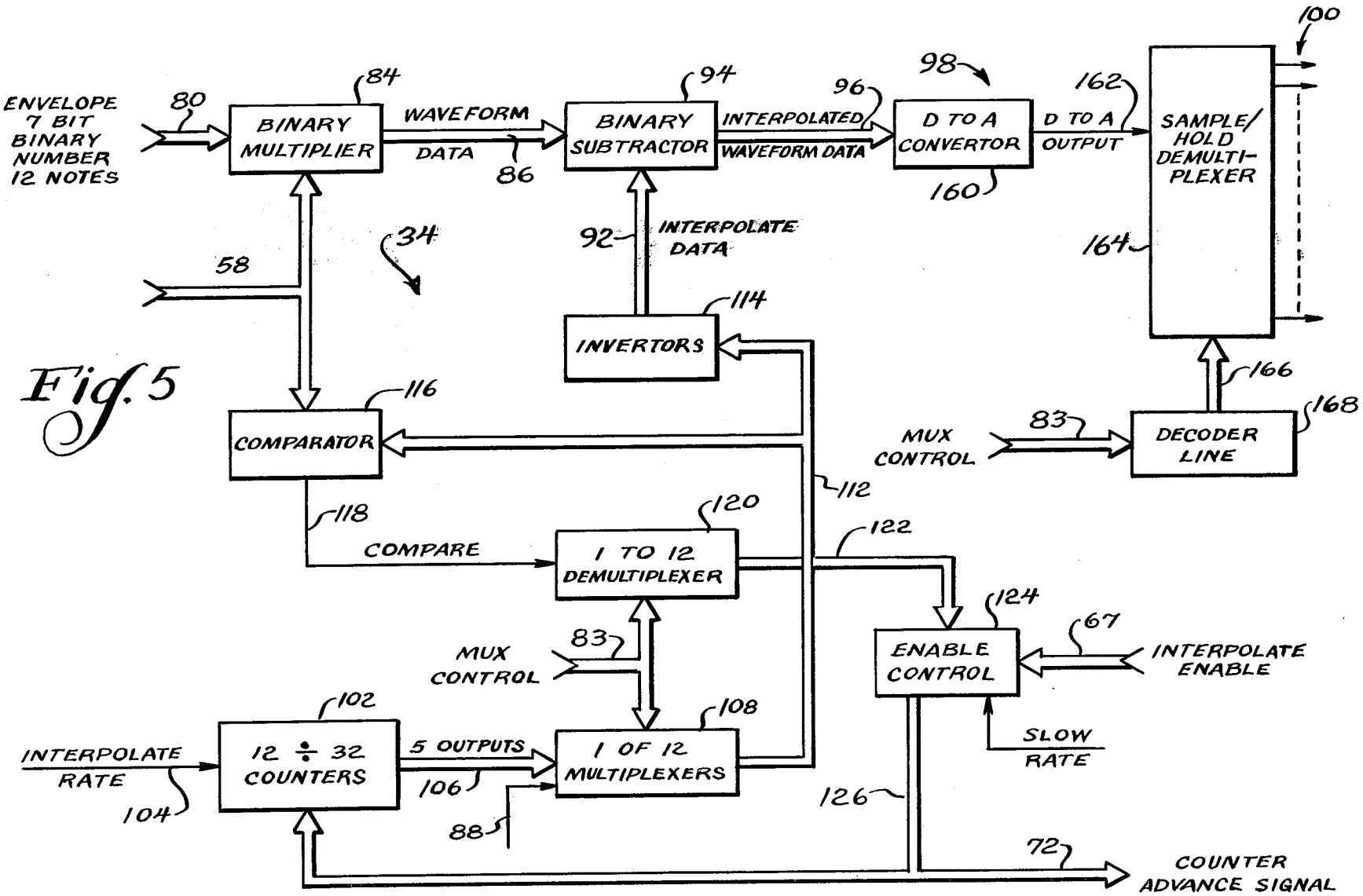
FIG. 5 is a block diagram of the binary interpolator circuit of this invention, in conjunction with related portions of the exemplary musical instrument of FIG. 3.

Referring now to FIG. 5, the binary interpolator circuit 34 is illustrated in additional detail, in block diagrammatic form, together with the related portions of the circuits of FIG. 3.

Initially, from the above description, it will be apparent that a binary coded signal or binary number characterizes each of the 64 output pulses or steps 12 the waveform 10 in FIG. 1. During the "slow" portion 20 of the waveform 10, the envelope ROMS 50 are adapted to produce envelope binary signals changing by only one least significant bit increment for each step or pulse 12. Accordingly, the relative amplitudes or change in amplitude between each adjacent pulse or step 12 is effectively defined or determined by the binary coded scaling signal or binary number produced at the output lines 58. In the illustrated embodiment, this signal comprises a five bit binary coded signal. Consequently for a particular note, the relative amplitude or change in amplitude between adjacent steps or pulses 12 may be as much as 31 times the least significant bit.

The binary interpolator 34, includes a plurality of divide-by-32 counters 102 driven by a clock signal on a line 104, at a suitable "interpolate rate". In the illustrated embodiment 12-divide-by-32 counters are utilized, one for each of the twelve notes of the octave of the keyboard 34, accommodated in this embodiment as described above. Thus, the divide-by-32 counters 102 each produce a five bit binary coded number which sequentially advances from binary one to binary 32 so as to be capable of reproducing the maximum amplitude change as noted above. These integrally advancing binary signals or numbers are suitably combined with the steps 12 in the portion 16 of the waveform of FIG. 1 to achieve the interpolation or digital reduction thereof as illustrated by FIG. 2.

Specifically, five output lines 106 of each divide-by-32 counter 102 are fed to a bank of one-of-twelve multiplexers 108 which receive the multiplex control lines 83 from the multiplex control circuits 82 of FIG. 3, to serially multiplex the signals from the twelve divide-by-32 counters 102 in unison with the serial multiplexing of the scaling signals at the multiplexer 46 and that of the envelope signals at the multiplexers 44 and 78. In the illustrated embodiment, the outputs of the one-of-twelve multiplexers 108 are fed via lines 112 to invertor circuits 114 whose outputs feed the lines 92 to the binary summation circuits 94. It will be noted that the multiplexers 108 also receive the enable/inhibit signal on the line 88, which enables their outputs 112 when one of the envelope pulse signals which is to be interpolated is present, as discussed above, but inhibits the outputs 112 when the signal present is not one which is to be interpolated, and therefore the interpolator circuit 34 is to be inhibited. The binary summation circuits 94 thus combine the binary coded envelope waveform data on the lines 86 with an inverted version of the interpolating signals produced by the divide-by-32 counters 102, in effect performing a binary subtraction. It will be appreciated that such subtraction is appropriate for the descending decay portion of the waveform 10 of FIG. 1. It will be readily apparent that should it be desired to similarly reduce or digitally interpolate an ascending waveform, these invertors 114 would not be utilized.

The interpolating signals from the divide-by-32 counters 102 are also serially multiplexed on the lines 112 to feed a comparator circuit 116. A second input to the comparator circuit 116 comprises the scaling signals on the lines 58. It will be remembered that both the scaling signals on the lines 58 and the divide-by-32 counter signals comprise five bit binary encoded signals. Moreover, it will be remembered that in the illustrated embodiment, the five bit scaling signals on the line 58 represent the difference in amplitude between the successive steps or pulses of the waveform for which interpolation or digital reduction is to be accomplished. Accordingly, the integrally advancing interpolating signals from the divide-by-32 counters 102 are compared, in the sequence in which they are produced, with the five bit binary scaling signal at the lines 58. When the signals are equal, that is to say when they correspond to the same binary number, the digital reduction or interpolation is complete for that step or pulse. To accommodate the maximum amplitude change, requiring a 32-step digital reduction, the interpolate rate signal 104 is chosen at least 31 times the time interval 22 of the envelope pulses, to assure full digital reduction of each pulse within its time interval 22. This is true because the interpolating signals on the lines 112 are in effect subtracted from the envelope step or pulse at the binary subtractor. Thus, when the magnitude of the signal subtracted from the envelope step or pulse reaches the scale or relative amplitude change between that step with respect to the next succeeding step or pulse the reduction or interpolation will thus be complete, there being no remaining amplitude difference to reduce.

Accordingly, the comparator circuit 116 is adapted to produce a compare control signal on its output line 118 when the two inputs thereto become equal. The comparator control signal on the line 118 is fed to a one-to-twelve demultiplexer 120 which also receives the control lines 83 from the multiplex control circuits 82 of FIG. 3 to operate simultaneously with the previously described multiplexing circuits. This one-to-twelve demultiplexer 120 then produces an output on one of its twelve output lines designated generally 122, which output lines control corresponding ones of the twelve divide-by-32 counters 102. Thus, each divide-by-32 counter is either inhibited or enabled due to the control signals on the lines 122, in accordance with whether its associated key or note envelope signal is currently presenting a step which is to be interpolated or digitally reduced. More specifically, the control signals on the lines 122 are fed to an enable control circuit 124, which also receives the interpolate enable lines 67 from the rate control circuits 66, and the same slow rate clock pulses fed to the count line 74. The enable control circuit 124 then feeds suitable enable or inhibit control signals on its output lines 126 to the divide-by-32 counters 102. These control lines 126 are also fed to the lines 72 to form the counter advance enable control signals for the rate control circuits 66 of FIG. 4, which it will be remembered comprise a portion of the input circuits 38 of FIG. 3. Accordingly, each divide-by-64 counter 62 of FIG. 4 associated with an input circuit 38 whose envelope signal is to be interpolated or reduced is allowed, in the proper sequence (as per the demultiplexer 120), to advance to its next count, thereby producing the next pulse or step 12 in the waveform 10 of FIG. 1. It will be recognized, however, that this enable signal on the line 72 does not itself advance the counter, as the time periods 22 of the steps 12 of FIG. 1 are fixed, as noted above. Rather, this counter advance enable signal merely assures that the digital reduction or interpolation process is complete, before allowing this counter to advance to the next step or pulse 12.

Figures 7, 8:
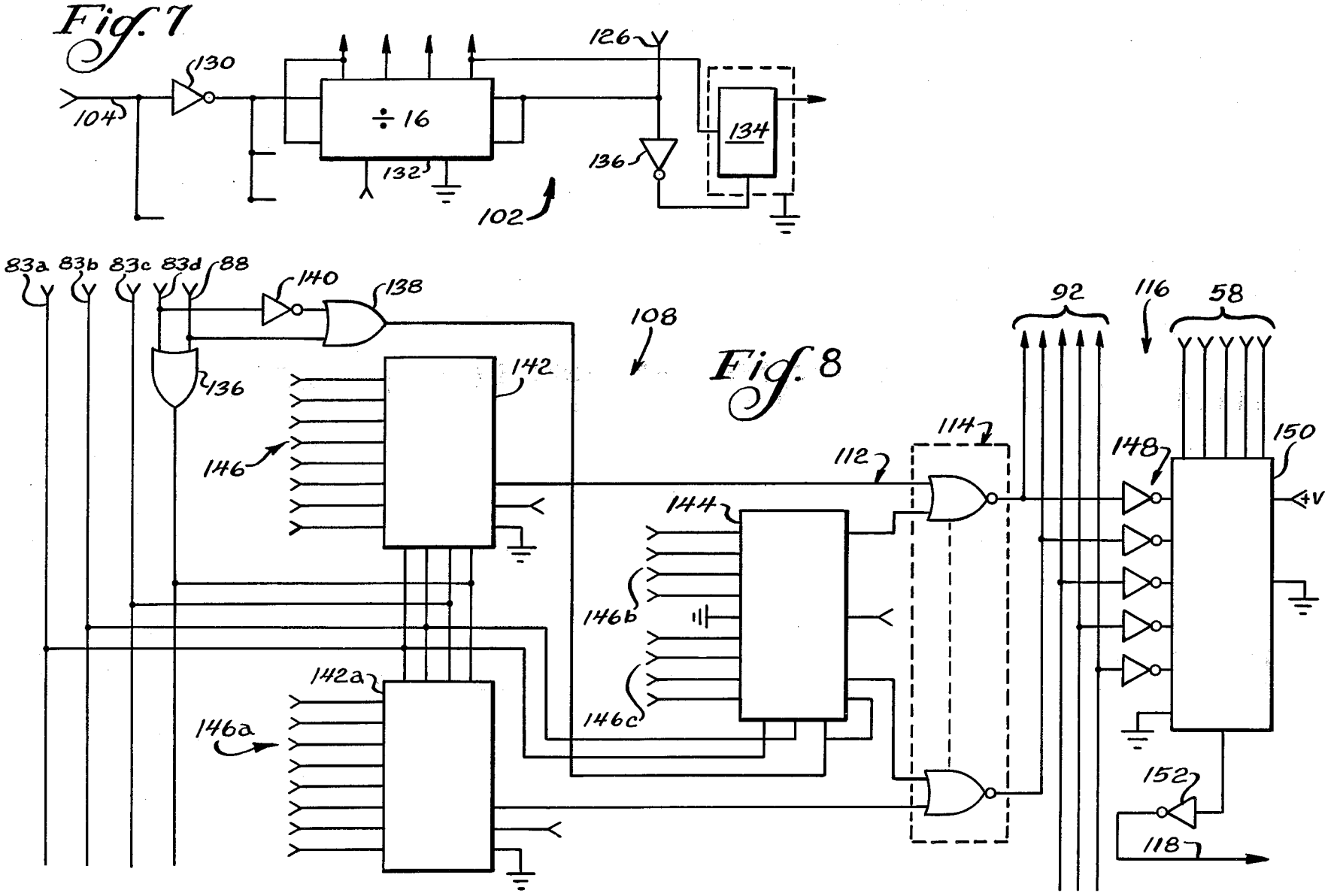
FIG. 7, FIG. 8, FIG. 9 and FIG. 10 are schematic circuit diagrams illustrating portions of the binary interpolator of FIG. 4 in additional detail.

Referring now to FIGS. 7 through 10, portions of the circuits of FIG. 5 comprising the binary interpolator 34 are illustrated in additional detail. Referring initially to FIG. 7, a typical one of the divide-by-32 counters 102 is illustrated. The interpolating rate or clock signal on the line 104 is fed through a suitable buffer 130 to the count input of a divide-by-16 counter 132. This divide-by-16 counter 132 may for example be of the type designated 74LS93. A divide-by-two or flip-flop circuit 134 is connected with the divide-by-sixteen counter 132 to effectively form the divide-by-32 counter 102. The associated enable control line 126 is fed to reset inputs of both the divide-by-sixteen counter 132 and the flip-flop 134, a suitable inverter 136 being interposed in the line to the flip-flop 134. Accordingly, it will be seen that the enable control signal produced when the interpolation is complete, as described above, effects a reset of the divide-by-32 counter such that only a binary coded "zero" signal is fed to its output and accordingly combined in the binary subtractor or summation circuit 94 with the envelope step, to effect no further change in the step upon completion of interpolation or reduction thereof.

Referring now to FIG. 8, the inverters 114, the comparator circuit 116 and a pair of typical ones of the one-of-twelve multiplexers 108, are illustrated. Initially, it will be seen that the multiplex control lines 83 comprise four lines designated 83*a*, 83*b*, 83*c* and 83*d*. Referring briefly to FIG. 6, the multiplex control signals are essentially clock pulses produced at predetermined rates to effect simultaneous operation of all the multiplexing and demultiplexing and demultiplexing circuits. FIGS. 6 illustrates an exemplary embodiment of the signals on these multiplex control lines, and further illustrates by comparison a typical sequence of envelope bit signals on the output lines 56 of the envelope ROMS 50. Accordingly, it will be seen that the envelope information generated by the divide-by-64 counters on the output lines 40 are multiplexed serially, in the same sequence as the multiplexing of the divide-by-32 counter 102 outputs on the lines 106, thus assuring envelope interpolation of each key or note actuated on the keyboard 35, in the same sequence actuated, so as to reproduce the note envelopes on the lines 100 in the same sequence played.

Referring again to FIG. 8, it will be seen that the control line 88 and the multiplex control line 83*d* are fed to a logic network comprising OR gates 136 and 138 and an invertor 140. The outputs of the gates 136 and 138 and the remaining multiplex control lines 83*a*, 83*b*, 83*c* are fed to suitable inputs of multiplexers, to be described below, for effecting control thereof in the fashion described above. The multiplexing function is accomplished by one-of-eight multiplexers 142 and 142*a* and a dual one-of-four multiplexer 144 which is interconnected therewith to form a pair of one-of-twelve multiplexers. It will be appreciated that only two of the one-of-twelve multiplexer circuits 108 are illustrated herein, it being understood that the remaining one of twelve multiplexers are similar in structure and function. In the illustrated embodiment, a total of five one-of-twelve multiplexers are utilized to serially multiplex through the five outputs of each of the twelve divide-by-32 counters 102. Accordingly, inputs 146, 146*a*, 146*b* and 146*c* of the respective multiplexers 142, 142*a* and 144 are the serially arranged outputs of the divide-by-32 counters 102. The function of the invertor circuits 114 is performed by a series of NOR gates which receives the outputs of the multiplexers 142, 142*a* and 144, in effect reproducing the count from the serially multiplexed divide-by-32 counters on the output lines 92. These outputs are also fed to inverters designated generally 148, which form inputs to the comparator circuit 116.

The comparing function of the comparator circuit 116 is performed by a five-bit comparator integrated circuit 150 which receives the outputs of these inverters 148, and also receives the scaling signals on the lines 58. The comparator circuit 150 may comprise for example an integrated circuit of the type generally designated 93L24. The output of the comparator circuit 116 on the line 118 comprises the output of the integrated circuit 150 fed through an inverter 152.

Figure 10:
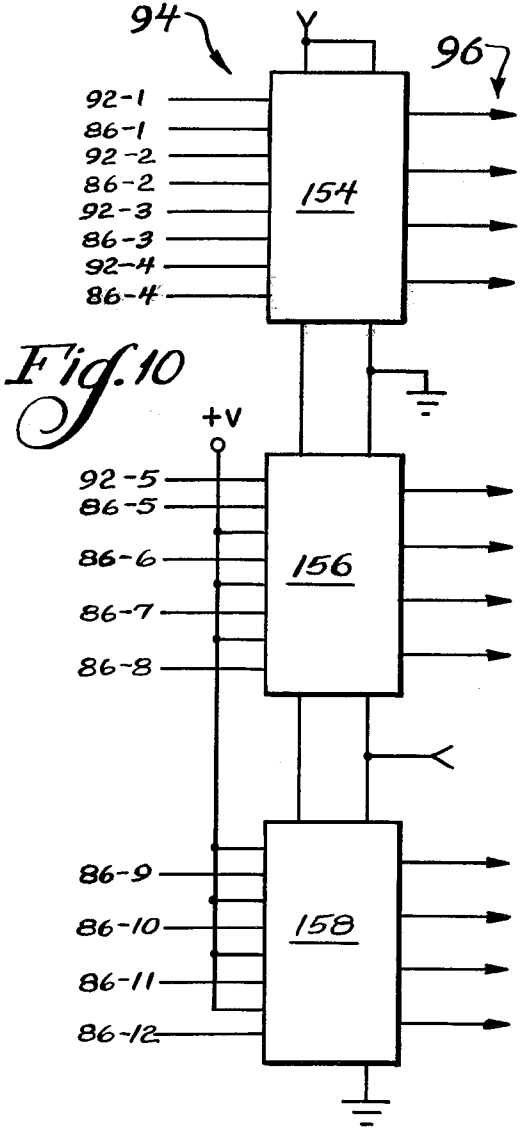

Referring now to FIG. 10, the binary summation or subtractor circuit 94 is illustrated. This circuit 94 comprises four bit adder circuits 154, 156 and 158, which may for example comprise integrated circuits of the type generally designated 74LS83. It will be seen that the interpolating signal data lines 92, which, it will be remembered, comprise lines carrying a five bit code representing the count from the divide-by-32 counter, enter the adders 154 and 156 as indicated by reference numerals 92-1 through 92-5. Similarly, the envelope step data on the lines 86, which in the illustrated embodiment comprises a twelve bit binary coded signal, enters the binary adders 154, 156 and 158 on the lines designated 86-1 through 86-12, inclusive. The remaining inputs of the adder circuits 156 and 158 are tied to a positive voltage supply. Accordingly, the outputs of the adder circuits 154, 156 and 158 comprise a twelve bit binary coded signal on twelve lines designated generally 96, which has been digitally reduced, if and as desired, according to the interpolating signals fed to the lines 92-1 through 92-5.

Referring again briefly to FIG. 5, it will be seen that these lines 96 are fed to a digital to analog converter circuit 160. The analog output of the converter 160 is fed on a line 162 to a sample and hold demultiplexer circuit 164 which receives suitable control signals on lines designated generally 166 from a decoder 168 which is operated by the multiplex control lines 83. Accordingly, the output lines designated generally 170 of the sample and hold demultiplexer 164 comprise twelve analog outputs corresponding to the twelve notes of the keyboard 35 of the illustrated embodiment. These output lines 170 then feed the corresponding analog envelope signals, interpolated as necessary, of these twelve keyboard notes, as actuated or played, to the audio reproduction or keying circuits of the associated instrument for generating the envelopes of the associated note signals.

Figure 9:
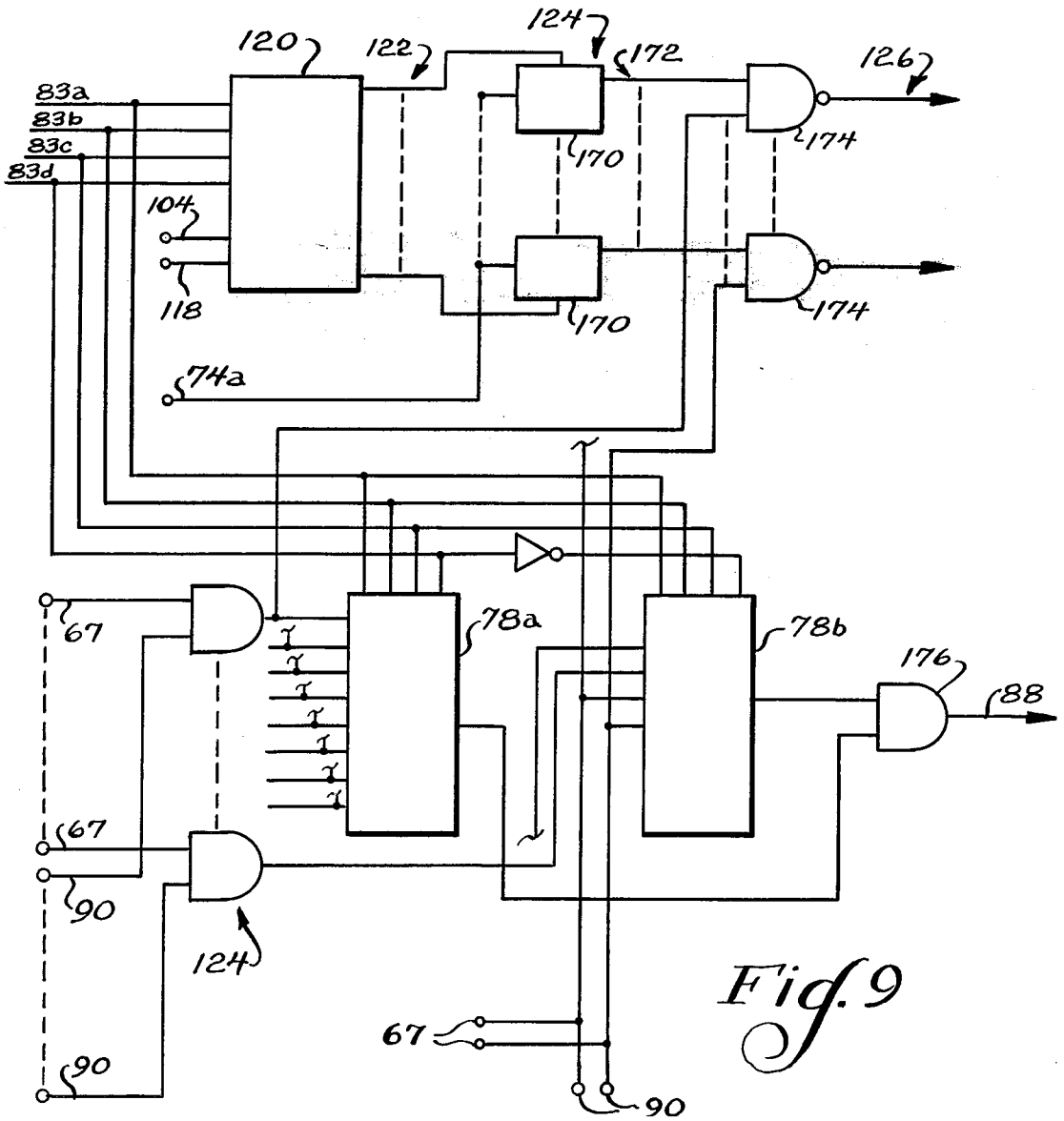

Referring now to FIG. 9, the one-to-twelve demultiplexer circuit 120, and enable control circuits 124 are illustrated, together with a portion of the multiplexing circuits 78 of FIG. 3 which cooperate therewith to produce the control signals on the line 88, and the respective reset and enable signals on the lines 126 to the divide-by-32 counters 102 and the divide-by-64 counters 62. The one-to-twelve demultiplexer circuit 120 comprises a four line to sixteen line demultiplexer IC which may be of the type generally designated 74LS64. However, it will be noted that only twelve of the outputs thereof are utilized. Four input signals comprising the multiplex control signals on the lines 83*a*, *b*, *c* and *d* are fed to the inputs of this demultiplexer IC to achieve serially demultiplexed signals therefrom in the same sequence in which the other multiplexing elements are operated. The interpolate rate 104 and line 118 of the comparator 116 form control inputs of the demultiplexer 120, to control the operation thereof in accordance with the rate 104 and with the compared signals (i.e., the interpolating signals and scaling signal). The lines 122 are fed to inputs of the enable control circuit 124 which comprises inputs to an array of flip-flops 170 which in accordance with the illustrated embodiment are twelve in number, corresponding to the twelve notes of the octave of the keyboard 35 being processed. The flip-flops 170 also receive the same inputs from the slow clock rate which are fed to the lines 174 of the divide-by-64 counters 62 in FIG. 4, which is here designated 74*a*. Outputs designated generally 172 of these flip-flops 170 are fed to one input of each of twelve NAND gates 174, whose outputs form the twelve control lines 126 which feed the reset inputs of the divide-by-32 counters 102 and the enable lines 72 to the rate control circuits 66 for the divide-by-64 counters 62 in FIG. 4. Referring now to the lower portion of FIG. 9, the portion of the multiplexer circuits 78 which handles the enable/inhibit control signals on the lines 90 of FIG. 3, are illustrated. It will be seen that the lines 90 and the lines 67 from the interpolate enable outputs of the rate control circuits 66 of FIG. 4 are fed to respective inputs of a plurality of AND gates designated generally 124*b* which form a part of the enable control 124. These AND gates 124*b* receive ten of the twelve lines 67 and a corresponding ten of the twelve lines 90. The outputs of these AND gates 124*b* feed the inputs of a one of twelve multiplexer comprising a pair of one of eight multiplexers designated 78*a* and 78*b* which are interconnected to form a one-of-twelve multiplexer circuit which is part of the circuits 78. The remaining two of each of the twelve sets of input lines 67 and 90 feed remaining inputs of the multiplexer circuits 78*a* and 78*b*, which may comprise for example, integrated circuits of the type generally designated 74LS151. It will be seen that these multiplexer circuits also receive the multiplex control lines 83. It will be further noted that the opposite inputs of the NAND gates 174 receive the same input signals, respectively, as the multiplexer circuits 78*a* and 78*b*. The outputs of the multiplexer circuits 78*a* and 78*b* are fed to an AND gate 176 whose output comprises the control line 88 to the one-of-twelve multiplexer circuits 108 of FIG. 8.

It will be appreciated from the above description, that the various integrated circuit components shown and described are relatively economically utilized due to the described serial multiplexing in the associated circuitry, to effect binary interpolation of up to twelve envelope waveforms as desired, while utilizing a minimum number of circuit components.

While the invention has been illustrated and described herein in connection with an exemplary embodiment, it is not intended to limit the invention thereto. On the contrary, other uses of the invention are contemplated, as well as such changes and modifications therein as may occur to those skilled in the art, and such alternatives, changes and modifications form a part of the present invention, insofar as they fall within the spirit and scope of the appended claims.

The invention is claimed as follows:

1. A binary interpolator circuit comprising: counter circuit means for producing sequential digitally coded interpolating signals at a predetermined rate, said interpolating signals corresponding to advancing digital numbers; combining circuit means for combining each of said interpolating signals, in the sequence produced, with a digitally coded envelope signal defining the amplitude of a portion of a waveform which portion is to be digitally reduced by interpolation and corresponding to a digital number, to form an interpolated output waveform, comparator circuit means for comparing the interpolating signals, in the sequence produced, with a digitally coded scaling signal defining the amplitude amount which is to be digitally reduced and for producing a control output signal having a first value normally and changing to a second value when said interpolating signals advance to the same corresponding digital number as the digitally coded scaling signal, and control circuit means responsive to said control output signal second value for resetting and holding said counter circuit means thereby halting production of said interpolating signals.

2. A binary interpolator circuit according to claim 1 further including means for setting said predetermined rate of production of said interpolating signals by said counter circuit means such that said resetting and holding of said counter circuit means occurs during the time between two points of the waveform defining therebetween the portion upon which interpolation is to be accomplished.

3. A binary interpolator circuit according to claim 1 wherein said counter circuit means comprises a plurality of digital electronic counter circuits for producing a corresponding plurality of said interpolating signals and further including multiplexer circuit means for serially multiplexing said plurality of interpolating signals to reproduce said interpolating signals in a predetermind sequence for serially interpolating between predetermined points in a plurality of simultaneously serially multiplexed waveforms.

4. A binary interpolator circuit according to claim 3 further including demultiplexer circuits operated simultaneously with said multiplexer circuit means and interposed between said comparator circuit means and each of said digital electronic counter circuits for serially feeding said control output signal to said digital electronic counter circuits.

5. A binary interpolator circuit according to claim 1 wherein said control circuit means further includes enable circuit means responsive to a subsequent predetermined portion of said waveform which is to be interpolated for enabling said counter circuit means to resume said production of said interpolating signals.

6. A binary interpolator circuit according to claim 3 further including a second demultiplexer circuit means operable simultaneously with said multiplexer circuit means and said first mentioned demultiplexer circuit means for serially outputting said interpolated output waveforms in the same sequence as interpolated.

7. A digital method for interpolation between two points of a digitally encoded waveform, the two points differing in amplitude by a factor defined by a scaling signal corresponding to a digitally coded number, said method comprising: producing a sequence of interpolating signals corresponding to integrally advancing digitally coded numbers; combining said interpolating signals, in the same sequence produced, with said digitally encoded waveform to produce an interpolated waveform; comparing said interpolating signals, in the same sequence produced, with said scaling signal; stopping said production of said interpolating signals corresponding to integrally advancing coded numbers and producing an interpolating signal corresponding to zero when said integrally advancing coded number reaches said coded scaling signal number; and combining only said interpolating signal comprising a coded zero with said encoded waveform following production of said zero, thereby effectively halting said interpolation.

8. A method of interpolation between adjacent steps of a stepwise changing waveform, the change in amplitude between the steps being defined by a scaling signal corresponding to a binary number and the waveform steps being generated at a first predetermined rate, the method comprising: generating, at a second predetermined rate substantially greater than said first predetermined rate, a sequence of binary coded interpolating signals corresponding to integrally changing binary numbers changing in the direction of amplitude change between the adjacent steps, combining each interpolating signal with the waveform, comparing each interpolating signal with the scaling signal, and producing a control signal for changing subsequent interpolating signals to a binary zero when the binary number corresponding to the interpolating signal is equal to the binary number corresponding to the scaling signal.

9. A method according to claim 8 further including the steps of serially multiplexing a plurality of stepwise changing waveforms to be interpolated and simultaneously serially multiplexing a plurality of said interpolating signals to be combined and compared with the respective scaling signals, and serially demultiplexing, in the same sequence as said serial multiplexing, said control signals for controlling the production of said serially multiplexed interpolating signals, thereby interpolating a plurality of said waveforms in a serially multiplexed fashion.

10. In combination with an electronic musical instrument including an envelope generating circuit for generating a sequence of envelope signal pulses of varying time periods and amplitudes so as to be characteristic of an attack and decay envelope of a percussive instrument such as a piano, the adjacent pulses in the sequence differing in amplitude by a factor defined by a predetermined digital number, an interpolating circuit for digitally reducing the amplitude differences between adjacent ones of the sequence of envelope signals by converting each envelope pulse to a sequence of pulses differing in amplitude only by at least significant bit of said predetermined digital number and occurring within the time period of the pulse being converted.

11. A binary interpolator for use with an electronic musical instrument, said instrument having key actuated means for generating a plurality of notes and an envelope waveform for each of said notes, said envelope waveforms being characteristic of a percussion instrument such as a piano and each comprising a sequence of binary coded pulses, the amplitude difference between predetermined adjacent ones of said pulses being defined by a scaling signal corresponding to a predetermined binary number for each note generated, and the time duration each of said pulses comprising a predetermined time, said binary interpolator comprising: a digital electronic circuit including means for serially multiplexing a plurality of said envelope signals and scaling signals, means for producing and simultaneously serially multiplexing a like plurality of interpolating waveform, said interpolating waveforms each comprising a sequence of binary coded signals corresponding to integrally changing binary numbers and occurring at time intervals substantially smaller than said predetermined time, means for combining the serially multiplexed interpolating signals with the serially multiplexed envelope signals to accomplish a stepwise interpolation in a serially multiplexed fashion between said predetermined adjacent pulses of each of envelope signals, means for comparing each of said serially multiplexed interpolating signals with the corresponding serially multiplexed scaling signal and means for converting the associated serially multiplexed interpolating signal to a binary zero when the compared signals are equal in value.

12. A binary interpolator according to claim 11 wherein said digital electronic circuit means further includes means responsive to said comparing means for enabling said electronic musical instrument to produce the next succeeding pulse of the associated envelope waveform when said compared signals are equal, and means responsive to the rate of generation of said next succeeding pulse for selectively enabling said binary interpolator to interpolate only such steps of said envelope waveform as occur at or below a predetermined rate.

13. A binary interpolator for digitally reducing an amplitude change between adjacent pulses of a digital waveform, which amplitude change is characterized by a binary coded scaling signal corresponding to a predetermined binary number, said binary interpolator comprising a digital electronic circuit including means for generating a sequence of binary coded interpolating signals corresponding to integrally advancing binary numbers, means for combining said interpolating signals, in the sequence generated, with said digital waveform, means for comparing said interpolating signals, in the sequence generated, with the binary coded scaling signal, said comparing means producing a first output signal normally and a second output signal when the binary numbers corresponding to the interpolating signal and to the scaling signal are equal, and control means responsive to said output signals for alternatively allowing or inhibiting said generation of interpolating signals.

14. A binary interpolator circuit according to claim 13 further including a plurality of said generating means and multiplexing means coupled thereto for serially multiplexing a plurality of said generated sequences of said interpolating signals for interpolation of a corresponding plurality of simultaneously serially multiplexed digital waveforms whose adjacent pulses are to be digitally reduced.

15. In an electric musical instrument, an envelope circuit for generating envelope signals characteristic of attack and decay characteristics of a percussion instrument such as a piano, comprising in combination: digital electronic circuit means for generating a sequence of a binary coded envelope pulse signals of predetermined time periods and amplitudes, the adjacent pulses in at least a portion of the sequence differing in amplitude by a factor defined by a scaling signal corresponding to a predetermined binary number, and digital electronic binary interpolator circuit means for digitally reducing the amplitude differences between adjacent pulses in said portion of said envelope waveform by converting each said envelope pulse in said portion to a sequence of pulse differing in amplitude only by a least significant bit of said predetermined binary number and occurring within the time period of the envelope pulse so converted.

* * * * *

UNITED STATES PATENT AND TRADEMARK OFFICE

CERTIFICATE OF CORRECTION

PATENT NO. : 4,205,575

DATED : June 3, 1980

INVENTOR(S) : WILLIAM R. HOSKINSON and PETER E. SOLENDER

It is certified that error appears in the above-identified patent and that said Letters Patent are hereby corrected as shown below:

In the list of "References Cited", change "5/1929" to --5/1979--; and add the following:

| | | | |
|---|---|---|---|
| 3,678,258 | 7/1972 | Patmore | 364/719 |
| 3,854,365 | 12/1974 | Tomisawa | 84/1.01 |
| 4,023,454 | 5/1977 | Obayashi | 84/1.01 |
| 4,036,096 | 7/1977 | Tomisawa | 84/1.03 |
| 4,059,040 | 11/1977 | Obayashi | 84/1.01 |
| 4,067,253 | 1/1978 | Wheelwright | 84/1.24 |

Column 8, line 49, change "output" to --outputs--;

Column 10, line 41, change "lines 174" to --lines 74--;

Column 14, line 44, change "pulse" to --pulses--.

Signed and Sealed this

*Sixteenth* Day of *December 1980*

[SEAL]

*Attest:*

SIDNEY A. DIAMOND

*Attesting Officer*

*Commissioner of Patents and Trademarks*